US007268661B2

(12) United States Patent
Li et al.

(10) Patent No.: US 7,268,661 B2
(45) Date of Patent: Sep. 11, 2007

(54) COMPOSITE FUSE ELEMENT AND METHODS OF MAKING SAME

(75) Inventors: Xiang-Ming Li, San Diego, CA (US); Liwu Wang, San Diego, CA (US); Jeffrey D. Montgomery, Vista, CA (US); Daniel H. Chang, Rancho Santa Fe, CA (US)

(73) Assignee: AEM, Inc., San Diego, CA (US)

( * ) Notice: Subject to any disclaimer, the term of this patent is extended or adjusted under 35 U.S.C. 154(b) by 292 days.

(21) Appl. No.: 10/952,097

(22) Filed: Sep. 27, 2004

(65) Prior Publication Data

US 2006/0066435 A1 Mar. 30, 2006

(51) Int. Cl.
*H01H 85/06* (2006.01)
*H01H 85/38* (2006.01)

(52) U.S. Cl. ..... 337/296; 337/276; 337/290

(58) Field of Classification Search ..... 337/186, 337/276, 159, 273, 290, 296; 29/623
See application file for complete search history.

(56) References Cited

U.S. PATENT DOCUMENTS

| | | | | | |
|---|---|---|---|---|---|
| 2,864,917 | A | | 12/1958 | Sundt | |
| 3,599,138 | A | * | 8/1971 | Kozacka | 337/29 |
| 4,006,443 | A | * | 2/1977 | Kouchich et al. | 338/215 |
| 4,100,523 | A | * | 7/1978 | Arikawa et al. | 337/163 |
| 4,320,374 | A | * | 3/1982 | Narancic et al. | 337/162 |
| 4,893,106 | A | * | 1/1990 | Goldstein et al. | 337/159 |
| 5,227,946 | A | * | 7/1993 | Jacobs et al. | 361/106 |
| 5,228,188 | A | | 7/1993 | Badihi et al. | |
| 5,245,308 | A | | 9/1993 | Herbias | |
| 5,296,833 | A | | 3/1994 | Breen et al. | |
| 5,406,245 | A | * | 4/1995 | Smith et al. | 337/273 |
| 5,432,378 | A | | 7/1995 | Whitney | |
| 5,453,726 | A | | 9/1995 | Montgomery | |
| 5,479,147 | A | | 12/1995 | Montgomery | |
| 5,691,689 | A | * | 11/1997 | Smith et al. | 338/22 R |
| 5,726,621 | A | | 3/1998 | Whitney et al. | |
| 5,858,454 | A | * | 1/1999 | Kiryu et al. | 427/118 |
| 5,963,121 | A | * | 10/1999 | Stygar et al. | 337/155 |
| 6,005,470 | A | | 12/1999 | Smith et al. | |
| 6,034,589 | A | | 3/2000 | Montgomery et al. | |
| 6,133,820 | A | * | 10/2000 | Duggal et al. | 338/22 R |
| 6,160,471 | A | * | 12/2000 | Rybka et al. | 337/278 |
| 6,299,466 | B1 | * | 10/2001 | Bolen et al. | 439/164 |
| 6,590,490 | B2 | | 7/2003 | Ackermann | |
| 6,943,660 | B2 | * | 9/2005 | Bower et al. | 338/47 |
| 7,069,642 | B2 | * | 7/2006 | Bower et al. | 29/619 |
| 2006/0051588 | A1 | * | 3/2006 | Galla | 428/413 |
| 2006/0091992 | A1 | * | 5/2006 | Mori et al. | 338/22 R |

* cited by examiner

*Primary Examiner*—Anatoly Vortman
(74) *Attorney, Agent, or Firm*—Morrison & Foerster LLP

(57) ABSTRACT

A composite fuse element includes a network or matrix of conductive material that is in contact and interspersed with arc suppressing materials at a particle level. In such a matrix, the conductive (e.g., metal) network and the arc suppressing material particles provides a large contact surface area between these materials. When the conductive network melts or vaporizes, the resulting conductive vapors are adsorbed into the arc suppressing particles in a short time due to the large contact area between conductive and arc suppressing materials and the short diffusion distance that the conductive vapors are required to travel before they are absorbed by the arc suppressing material.

15 Claims, 2 Drawing Sheets

COMPOSITE FUSE ELEMENT AND METHODS OF MAKING SAME

BACKGROUND OF THE INVENTION

1. Field of the Invention

The present invention relates to fuses for protecting electrical circuits from high-current levels and, more particularly, to a fuse element that is made from a composition of conductive and arc suppressing materials.

2. Description of Related Art

Our contemporary society enjoys the convenience and utility offered by the plethora of modern electronic devices available to industry, businesses and consumers. Electronic devices, however, often contain circuitry or components that may be sensitive to certain levels of current. Spikes or otherwise higher-than-nominal current levels are often referred to as over-current conditions. The occurrence of over-current conditions may result in damage to or destruction of the circuitry or components of the electronic device. As a result, designers often utilize fuses to shield the circuitry from such conditions.

Fuses are well known and widely used for over-current protection of electronic circuits. Many current limited fuses are made of metal wires, metal sheets, or metal films as the fusing elements. When the electrical current passing through the fusing element exceeds a certain level, the heat generated by the electrical current will melt the fusing element and create an open circuit, thereby preventing further current flow. Occasionally, however, when the fuse element melts and vaporizes, arcing occurs. It can allow undesired current levels to reach the circuit to be protected, potentially causing damage to the circuit. Therefore, the fusing elements are typically surrounded by arc suppressing or arc shielding materials. Many types and designs of such fuses are known in the art and such fuses are described, for example, in U.S. Pat. Nos: 6,590,490; 6,005,470; 5,726,621; 5,479,147; 5,453,726; 5,296,833; 5,245,308; 5,228,188; and 2,864,917.

A good fuse should have good arc suppressing capability by quenching the arc in a short time. In order to quench or suppress the arc, several materials, like ceramic powder, glass, organic materials, etc, are used to enclose the fusing elements. These arc-suppressing materials absorb the metal vapor created by the melting/vaporizing fuse element and cut off the current through the arc. Currently, arc suppressing materials are used in locations surrounding the fusing elements in many commercially available fuses. One limitation of such conventional fuse designs, however, is the limited contact surface area between the fuse element and the arc suppressing material(s). Because of the limited contact surface area between the conductive material(s) and surrounding arc suppressing material(s), the time it takes for the arc suppressing materials to cut off or quench an arc resulting from a high current load on the fuse element may be unduly long, potentially allowing high current levels to reach an electronic circuit or component to be protected. Thus, a larger contact surface area between the conductive material of a fuse element and an arc suppressing material is desirable for better and faster arc quenching.

SUMMARY OF THE INVENTION

The invention addresses the above and other needs by providing an improved fuse element made from a composition of conductive material(s) and arc suppressing material (s) such that the contact surface area between the conductive material(s) and arc suppressing material(s) is increased, thereby providing increased and faster arc quenching capability.

In one embodiment, a fuse element is made from a composition of conductive metals and/or alloys and one or more arc suppressing materials. The mixed materials are bonded together to form an electrically conductive network of conductive particles (e.g., from a powder) with arc suppressing material particles (e.g., from a powder) mixed with and embedded inside the network of conductive particles. Thus, conductive materials and arc suppressing materials are mixed and come in contact with one another at a particle level or a microscopic scale. This inter-connected network of particles provides a larger contact surface area between the conductive materials and the arc suppressing materials. Consequently, when the fuse element melts, vaporizes, and forms the arc, the arc suppressing materials can quench an arc in a very short time because of a shorter diffusion distance between the metal vapors and arc suppressing materials.

In another embodiment, a metal or alloy film is coated onto the surface of one or more arc suppressing material particles or powders. The metal and/or alloy coated arc suppressing particles are then pressed or stuck together by an adhesive to form the fuse element. In one embodiment a subsequent sintering process sinters the particles or powders together to form a solid matrix.

In a further embodiment, metal and/or alloy particles or powders and arc suppressing material particles or powders are mixed and stuck together by an adhesive without sintering. The adhesives include epoxy, silicone rubber, and thermoplastics.

In another embodiment, arc suppressing material particles (e.g., a powder) are coated with a conductive metal and/or alloy film and then mixed and stuck together using an adhesive. The adhesives include epoxy, silicone rubber, and thermoplastics.

DETAILED DESCRIPTION OF THE PREFERRED EMBODIMENTS

The invention, in accordance with various preferred embodiments, is described in detail below with reference to the figures, wherein like elements are referenced with like numerals throughout.

Figure 1:
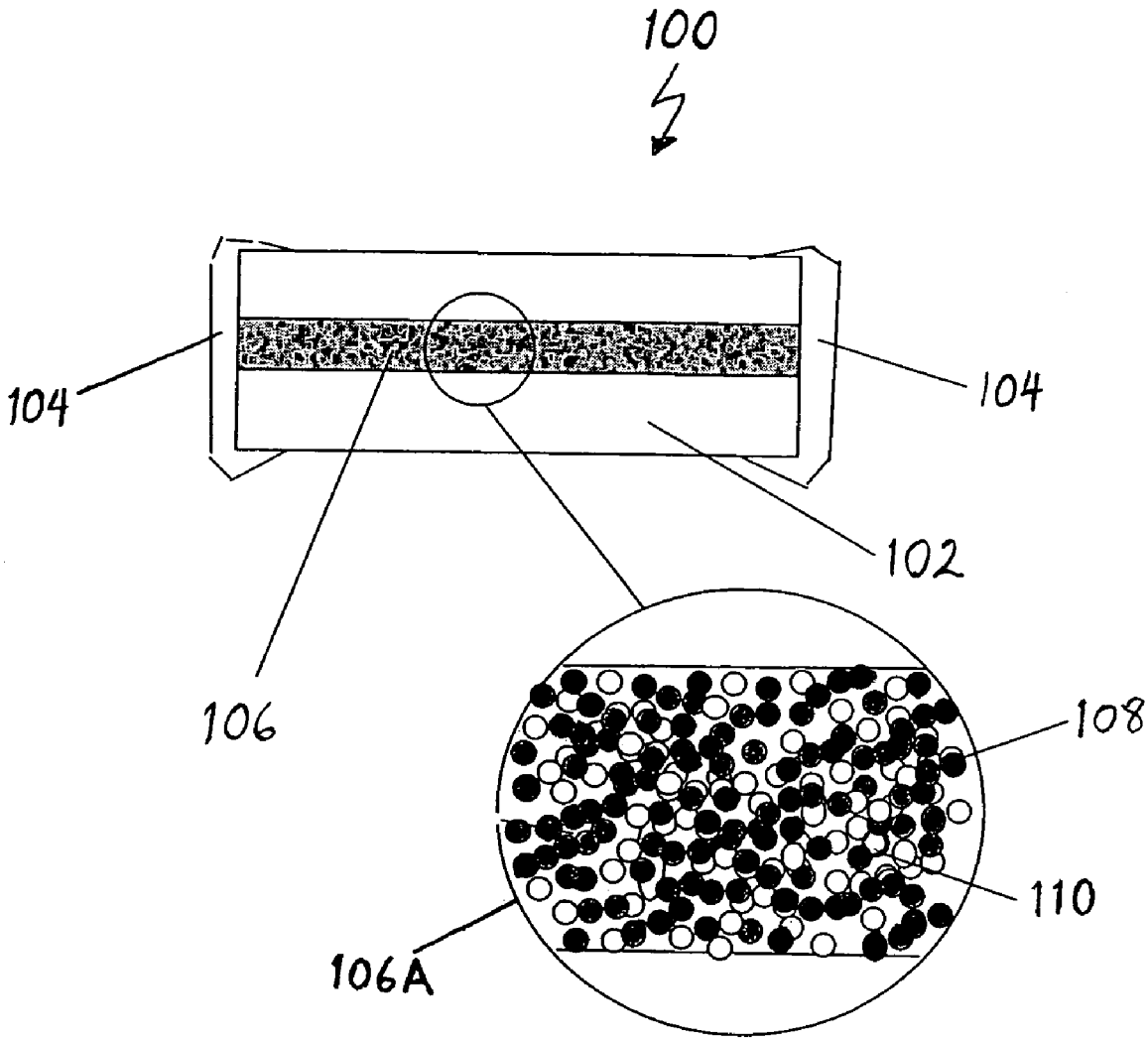
FIG. 1 illustrates a cross-sectional view of a surface mount fuse device having a composite fuse element, with a magnified view of a cross-sectional portion of the fuse element, in accordance with one embodiment of the invention.

FIG. 1 illustrates a cross-sectional side view of a fuse 100 in accordance with one embodiment of the invention. The fuse 100 includes a fuse body 102 made from one or more layers of insulating material, such as glass ceramics, glass bond alumina or silicate, glass, ceramic materials, polymer materials with fire retardants, or other known suitable insulating materials. Two electrically conductive contact terminals 104 are positioned at opposite ends of the fuse body 102 to provide electrically conductive contacts to each end of a fuse element 106 disposed within the fuse body 104 and between the two contact terminals 104.

A cross-sectional portion of the fuse element 106 is magnified and shown within the circular region 106A of FIG. 1. As shown in circular region 106A, the fuse element 106 comprises a composite of conductive metal and/or alloy particles 108 (indicated by the dark or solid circular particles) and arc suppressing particles 110 (indicated by white circular particles). In one embodiment, the particles 108 and 110 are mixed together and bonded together to form an electrically conductive network of interconnected conductive particles with arc suppressing particles embedded inside the conductive network and contacting the conductive particles. This network of interconnected conductive and arc suppressing particles provides a large total contact surface area between the conductive material of the fuse element and the arc suppressing materials, which allows the arc suppressing material to quench an arc in a very short time.

When an electrical current passing through the fuse element 106 exceeds a certain level, the heat generated by the electrical current will begin melting the conductive particles 108 (e.g., metal particles) and the arc suppressing particles 110 (e.g., glass particles) of the fusing element 106 creating an "open circuit." However, as the metal particles 108 melt and vaporize, metal vapors are formed which can allow arcing. The melted or melting glass particles 110 absorb the metal vapors and cut off any current flow through the arc. Due to the increased contact surface area between the conductive material 108 and the arc suppressing material 110, and the short diffusion distance between the conductive vapors and the melted arc suppressing material, the fuse element 106 of the invention allows faster arc quenching or suppression. Additionally, because the fuse element 106 provides superior arc quenching, the fuse 100 having the fuse element 106 can be rated with higher current and voltage ratings when compared to other fuses of the same or comparable size.

It is appreciated that the ratio of conductive materials to arc suppressing materials can be varied and different conductive materials and/or different arc suppressing materials may be used depending on the desired conductivity, melting points, voltage rating and/or current rating of the fuse 100. The conductive materials can include metals or alloys such as silver, gold, tin, zinc, copper and aluminum, or any mixture or combination of these materials or other known electrically conductive materials. The arc suppressing materials can include glass, glass ceramic, ceramic, inorganic salts, or any mixture or combination of these materials or other known arc suppressing materials. Those of ordinary skill in the art can design, without undue experimentation, a fuse element 106 using various combinations and ratios of the above materials to achieve desired properties and/or voltage/current ratings for a fuse 100, in accordance with the invention. In one embodiment, the ratio or percentage of conductive material to arc suppressing should be greater than 50% by volume such that there is the same or larger amount of conductive material 108 in the fuse element 106 then there is arc suppressing material 110.

Figure 2:
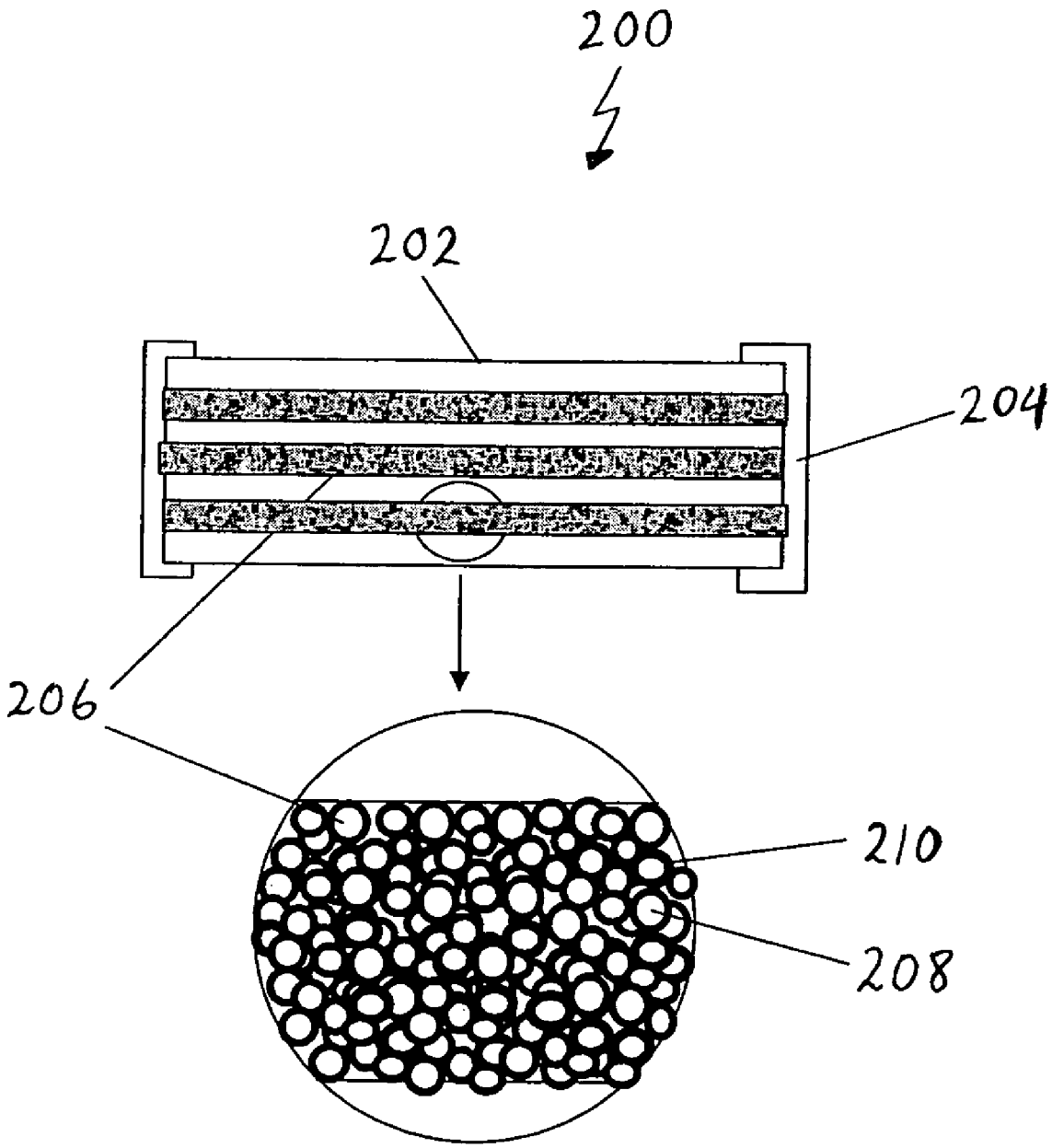
FIG. 2 illustrates a cross-sectional view of a surface mount fuse device having a plurality of parallel fuse elements, with a magnified view of a cross-sectional portion of one of the fuse elements, in accordance with one embodiment of the invention.

It is further appreciated that FIGS. 1 and 2 are not necessarily drawn to scale and are intended to merely illustrate certain features or aspects of the invention. For example, although the particles 108 and 110 are circular in shape in FIG. 1, they can have other shapes and varying sizes, such as oblong or cubicle or any other arbitrary shape. In one embodiment, the particle sizes range from 0.3 to 20 microns in diameter. However, various particle sizes and shapes may be utilized in the present invention.

Additionally, the number of particles 108 and 110 illustrated in the circular region 106A is exemplary only and does not necessarily represent all the particles actually present in a cross-sectional view of an actual fuse element 106. It is appreciated that an actual cross-section of a fuse element 106 may include a far greater number of particles 108 and/or 110, which are more tightly compacted together.

In one embodiment, a method of making a composite fuse 100 includes mixing a metal or alloy powder with an arc suppressing material powder. This powder mixture is then pressed together and the particles are stuck together with one or more adhesive materials to form the fuse element 106. The adhesive can include an epoxy, silicone rubber and/or thermoplastic material, or other known suitable adhesives or combinations thereof.

In one embodiment, the adhesive is applied to the powder mixture through known milling and grinding processes. For example, the adhesive can be dissolved in a solvent and the powder can then be mixed with the adhesive solution. The solvent is then dried out after the fuse element 106 is formed, leaving the powders stuck together with the adhesive. In further embodiments, high-shear mixing (e.g., roll milling, bead milling, high speed stirring, etc.) is performed to uniformly mix the adhesive or adhesive solution with the powders. Thereafter, the shape of the fuse element 106 is formed by screen printing, extrusion, molding, pressing, stamping and/or other techniques known in the art.

In one embodiment, a subsequent sintering process sinters the metal or alloy with arc suppressing material powders into a matrix form. Sintering is a well known process for adhering particles to one another using heat diffusion so that the particles stick to one another. The temperature at which the materials are "fired" depends on the type of materials used and those of ordinary skill in the art are aware of the appropriate sintering temperatures for the various materials discussed herein. The sintering temperature should be below the melting point of a particular material and a typical range of temperatures is between 500 degrees Celsius and 1,000 degrees Celsius, for typical time periods ranging from ten minutes to several hours.

In various embodiments, the conductive network of the composite fuse element 106 can be made of a single metal powder, a mixture of metal powders with different melting points, a single alloy powder or mixture of alloy powders, or mixture of metal and/or alloy powders. The arc suppressing materials can be made of glass, ceramics, glass-ceramics, inorganic salts, or any mixture of these materials. The fuse element 106 can be sintered with the fuse body layers 102 or sintered alone and incorporated with fuse body layers 102 in a later assembly stage of the fuse 100.

Referring to FIG. 2, a fuse 200 in accordance with another embodiment of the present invention is illustrated. The fuse 200 includes a fuse body 202 made from an insulating material and two contact terminals 204 at each end of the fuse body 202. Disposed between the two contact terminals 204 and within the fuse body 202 are a plurality of fuse elements 206 connected in parallel between the contact terminals 204. It is appreciated that the fuse 200 can also have less (e.g., only one) or more fuse elements 206 connected in parallel depending on desired current ratings for the fuse 200. This is also the case for the fuse 100 described above in connection with FIG. 1.

FIG. 2 provides a magnified view of a circular region 206A of the cross-sectional view of a fuse element 206. As shown in the circular region 206A, the fuse element 206 includes a plurality of arc suppressing particles 208 (illustrated as white circles) which are coated with a layer or film of conductive material 210, indicated by a dark ring or band 210 surrounding the arc suppressing particles 208. The coating process can be vapor deposition, electrical or electro-less plating, or other coating processes known in the art. The metal and/or alloy coated powder particles 208, 210 are then pressed or stuck together using an adhesive to form the fuse element 206. Techniques for mixing an adhesive or adhesive solution with the coated particles 208, 210 include those discussed above in connection with FIG. 1. In one embodiment, a subsequent sintering process sinters the particles together and forms a solid matrix fuse element 206. The conductive materials, arc suppressing materials and adhesives can be similar to those described above with respect to FIG. 1.

In another embodiment, metals and/or alloy powders and arc suppressing material powders, described above in connection with FIG. 1, are mixed and stuck together by an adhesive without sintering. Similarly, in another embodiment, the arc suppressing material powders coated with a film of conductive material, described above in connection with FIG. 2, are mixed and stuck together by an adhesive without sintering. The adhesive can include epoxy, silicone rubber, and thermoplastics and/or other known suitable adhesives.

As described above, the invention provides an improved fuse element with superior arc quenching characteristics. The fuse element comprises a network or matrix of conductive material providing conductive pathways that are in contact and interspersed with arc suppressing materials at a particle level. In such a matrix, the conductive (e.g., metal) network and the arc suppressing material particles provides a large contact surface area between these materials. When the conductive network melts and vaporizes, the resulting conductive vapors are adsorbed into the arc suppressing particles in a short time due to the large contact area between conductive and arc suppressing materials and the short diffusion distance that the conductive vapors are required to travel before they are absorbed by the arc suppressing material. Thus, the advantages of the composite fuse element of the invention include superior arc quenching and the ability to achieve higher current and/or voltage ratings when compared to conventional fuses of the same or similar size.

Various preferred embodiments of the invention have been described above. However, it is understood that these various embodiments are exemplary only and should not limit the scope of the invention as recited in the claims below. Various modifications of the preferred embodiments described above can be implemented by those of ordinary skill in the art, without undue experimentation. These various modifications are contemplated to be within the spirit and scope of the invention as set forth in the claims below.

What is claimed is:

1. A one-time use current-limiting fuse, comprising:

a fuse body have a first end and a second end;

a first contact terminal located at the first end of the fuse body;

a second contact terminal located at the second end of the fuse body;

a composite fuse element located within the fuse body and having a first end electrically coupled to the first contact terminal and a second end electrically coupled to the second contact terminal, wherein the composite fuse element comprises a plurality of arc suppressing particles interspersed within and in contact with an electrically conductive network comprising a plurality of conductive material particles, the size of substantially all of the arc suppressing particles and substantially all of the conductive material particles being within a range of 0.3 to 20 microns in diameter.

2. The fuse of claim 1 wherein the electrically conductive network of conductive material comprises the plurality of conductive material particles mixed with and in contact with the arc suppressing particles.

3. The fuse of claim 2 wherein the conductive material particles are adhered to the arc suppressing particles using an adhesive.

4. The fuse of claim 3 wherein the adhesive is selected from a group consisting of: epoxy, silicone rubber and thermoplastics.

5. The fuse of claim 3 wherein the conductive particles are further sintered to the arc suppressing particles.

6. The fuse of claim 2 wherein the conductive particles are sintered to the arc suppressing particles.

7. The fuse of claim 1 wherein the composite fuse element is sintered to the fuse body.

8. The fuse of claim 1 wherein the electrically conductive network of conductive material comprises a coating of conductive material on the arc suppressing particles.

9. The fuse of claim 8 wherein the arc suppressing particles coated with the conductive material are adhered to one another using an adhesive.

10. The fuse of claim 9 wherein the adhesive is selected from a group consisting of: epoxy, silicone rubber and thermoplastics.

11. The fuse of claim 10 wherein the arc suppressing particles coated with conductive material are further sintered so as to adhere to one another.

12. The fuse of claim 8 wherein the arc suppressing particles coated with conductive material are sintered so as to adhere to one another.

13. The method of claim 5 wherein the conductive particles are sintered to the arc suppressing particles at a temperature above 500° C.

14. The method of claim 6 wherein the conductive particles are sintered to the arc suppressing particles at a temperature above 500° C.

15. The method of claim 7 wherein the conductive particles are sintered to the arc suppressing particles at a temperature above 500° C.

* * * * *